United States Patent [19]

Milligan et al.

[11] Patent Number: 5,075,068

[45] Date of Patent: Dec. 24, 1991

[54] METHOD AND APPARATUS FOR TREATING MELTBLOWN FILAMENTS

[75] Inventors: Mancil W. Milligan, Knoxville, Tenn.; Robert R. Buntin, Baytown, Tex.; Fumin Lu, Knoxville, Tenn.

[73] Assignee: Exxon Chemical Patents Inc., Linden, N.J.

[21] Appl. No.: 596,057

[22] Filed: Oct. 11, 1990

[51] Int. Cl.[5] ..... D01D 5/08; D01D 7/00

[52] U.S. Cl. ..... 264/555; 156/167; 264/115; 264/210.8; 264/211.12; 264/211.14

[58] Field of Search ..... 264/6, 12, 555, 115, 264/210.8, 211.14, 211.12; 425/7, 72.2, 66; 156/167

[56] References Cited

U.S. PATENT DOCUMENTS

| | | | |
|---|---|---|---|
| 3,806,289 | 4/1974 | Schwarz | 264/211.17 |
| 3,825,379 | 7/1974 | Lohkamp et al. | 425/72.2 |
| 3,825,380 | 7/1974 | Harding et al. | 425/72.2 |
| 3,959,421 | 5/1976 | Weber et al. | 264/6 |
| 3,978,185 | 8/1976 | Buntin et al. | 264/121 X |
| 4,568,506 | 2/1986 | Kiriyama et al. | 264/171 |
| 4,594,202 | 6/1986 | Pall et al. | 264/8 |
| 4,622,259 | 11/1986 | McAmish et al. | 428/171 |
| 4,818,463 | 4/1989 | Buehning | 264/40.1 |
| 4,904,174 | 2/1990 | Moosmayer et al. | 425/174.8 |
| 4,925,601 | 5/1990 | Vogt et al. | 264/6 |

*Primary Examiner*—Mary Lynn Theisen

*Attorney, Agent, or Firm*—Jaimes Sher

[57] ABSTRACT

A meltblowing die is provided with means for discharging crossflow air onto meltblown filaments to disrupt their shape and flow pattern between the die and the collector. The disruption enhances drag forces imparted by the primary meltblowing air and results in smaller diameter filaments.

11 Claims, 1 Drawing Sheet

METHOD AND APPARATUS FOR TREATING MELTBLOWN FILAMENTS

This invention relates generally to the preparation of meltblown filaments and webs. In one aspect the invention relates to a method of manufacturing meltblown webs having improved strength.

Meltblowing is a one step process in which a molten thermoplastic resin is extruded through a row of orifices to form a plurality of polymer filaments (or fibers) while converging sheets of high velocity hot air (primary air) stretch and attenuate the hot filaments. The filaments are blown unto collector screen or conveyor where they are entangled and collected forming a nonwoven web. The converging sheets of hot air impart drag forces on the polymer strands emerging from the die causing them to elongate forming microsized filaments (typically 0.5–20 microns in diameter). Secondary air is aspirated into the filament/air stream to cool and quench the filaments.

The meltblown webs have unique properties which make them suitable for a variety of uses such as filters, battery separators, oil wipes, cable wraps, capacitor paper, disposable liners, protective garments, etc. One of the deficiencies, however, of the meltblown webs, is their relatively low tensile strength. One reason for the low tensile strength is the fact that the filaments have only moderate strength. Although the primary air draws down the filaments, tests have shown that the polymer molecular orientation resulting therefrom is not retained. Another reason for low strength is the brittle nature of the filaments when collected close to the die (e.g. less than 18"). Another deficiency for many applications is a relatively broad distribution of filament sizes within a single web.

Efforts have been made to alter the properties of the web by treating the filaments between the die and the collector, but none have been directed primarily at increasing the strength of the web. For example, in accordance with U.S. Pat. No. 3,959,421, a liquid spray has been applied to filaments near the die discharge to rapidly quench the filaments for the purpose of improving the web quality (e.g. reduction in the formation of "shot"). Also, cooling water was employed in the process described in U.S. Pat. No. 4,594,202 to prevent fiber bonding. U.S. Pat. No. 4,904,174 discloses a method for applying electrostatic charges to the filaments by creating an electric field through which the extruded filaments pass. U.S. Pat. No. 3,806,289 discloses a meltblowing die provided with a coanda nozzle for depositing fibers onto a surface in a wavey pattern.

SUMMARY OF THE INVENTION

It has been discovered that by disrupting the flow of the hot polymeric filaments discharged from a meltblowing die, the drawdown of the filaments can be increased. The increased drawdown results in several improved properties of the meltblown web or mat, including improved web strength, improved filament strength, more uniform filament diameter, and softer, less brittle web.

In accordance with the present invention the extruded filaments between the meltblowing die and the collector screen (or substrate) are contacted with crossflow air of sufficient intensity to disrupt the natural flow shape of the filaments. The crossflow air causes the filaments to assume an undulating or flapping flow behavior beginning near the die discharge and extending to the collector.

Tests have shown that the undulating or flapping flow behavior results in significantly increased drawdown of the filament. ("Drawdown" as used herein means the ratio of the emerging filament diameter at the die tip to final diameter.)

Although the reasons for the improved results have not been fully developed, it is believed that the disruption of the filament flow in a region near the die discharge creates a condition for improved drag of the primary air on the filaments. In the normal filament flow (without crossflow air) the primary air flow is substantially parallel to filament flow, particularly near the die discharge. However by creating undulations in the filament flow near the die discharge, portions of the filament are positioned crosswise of the primary air flow thereby increasing the effects of drag thereon.

For clarity of description, the crossflow medium is referred to as "air" but other gases can be used. The water spray techniques disclosed in U.S. Pat. Nos. 3,959,421 and 4,594,202 does not sufficiently disrupt the filaments to achieve the desired results. It should also be noted that the coanda discharge nozzle cannot be used as taught in U.S. Pat. No. 3,806,289 because such an arrangement would not result in increased drawdown but merely pulses the filaments to one side of the coanda nozzle in providing a wavey deposition pattern of the fibers on the collecting surface.

DESCRIPTION OF THE PREFERRED EMBODIMENTS

Figure 1:
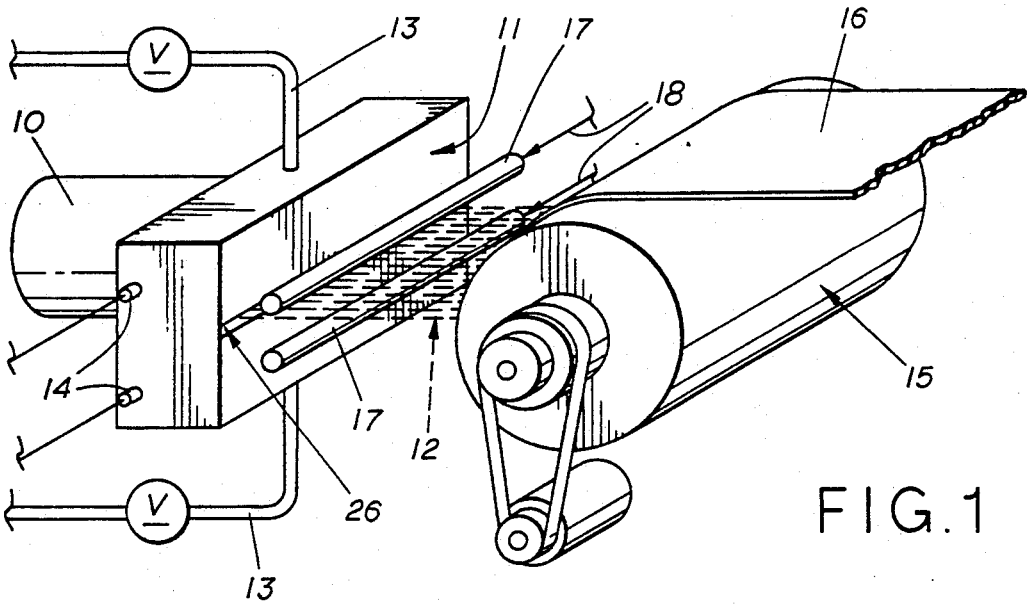
FIG. 1 is a perspective view of a meltblowing apparatus capable of carrying out the method of the present invention.

As mentioned previously, the present invention relates to the application of crossflow air onto the row of filaments discharging from a meltblowing die. A meltblowing line with crossflow air chambers is illustrated in FIG. 1 as comprising an extruder 10 for delivering molten resin to a meltblowing die 11 which extrudes molten polymer strands into converging hot air streams forming filaments. (12 indicates generally the center lines of filaments discharged from the die 11). The filament/air stream is directed onto a collector drum or screen 15 where the filaments are collected in a random entanglement forming a web 16. The web 16 is withdrawn from the collector 15 and may be rolled for transport and storage.

The meltblowing line also includes heating elements 14 mounted in the die 11 and an air source connected to the die 11 through valved lines 13.

In accordance with the present invention, the meltblowing line is provided with air conduits 17 positioned above and/or below the row of filaments 12 discharging from the die 11. As will be described in more detail below, each conduit 17 has a longitudinal slot for directing air onto the filaments 12. (The term "filament" as used herein includes both continuous strands and discontinuous fibers.)

Figure 2:
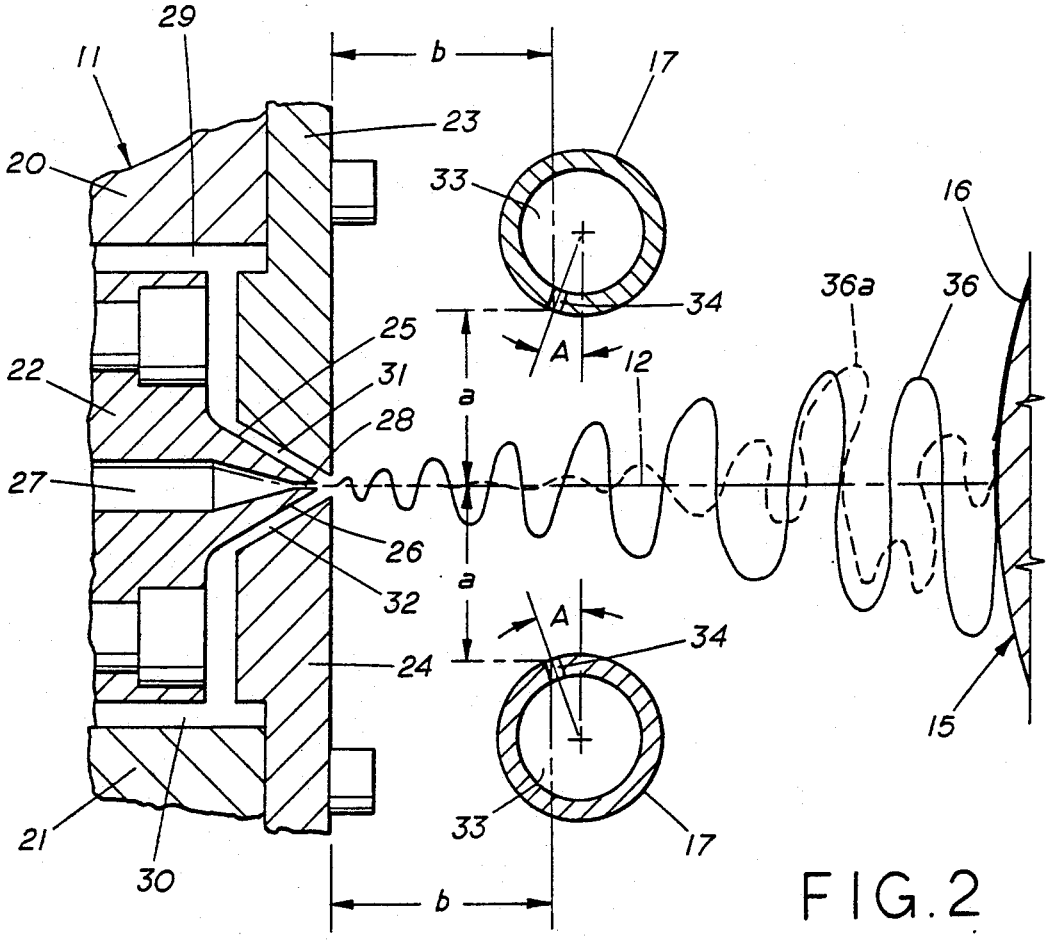
FIG. 2 is a side elevation of meltblowing die, illustrating schematically the flow shape of the filaments with and without crossflow air.

As shown in FIG. 2, the meltblowing die 11 includes body members 20 and 21, an elongate nosepiece 22 secured to the die body 20 and air plates 23 and 24. The nosepiece 22 has a converging die tip section 25 of triangular cross section terminating at tip 26. A central elongate passage 27 is formed in the nosepiece 22 and a plurality of side-by-side orifices 28 are drilled in the tip 26. The orifices generally are between 100 and 1200 microns in diameter.

The air plates 23 and 24 with the body members 20 and 21 define air passages 29 and 30. The air plates 23 and 24 have tapered inwardly facing surfaces which in combination with the tapered surfaces of the nosepiece 25 define converging air passages 31 and 32. As illustrated, the flow area of each air passage 31 and 32 is adjustable. Molten polymer is delivered from the extruder 10 through the die passages (not shown) to passage 27, and extruded as a microsized, side-by-side filaments from the orifices 28. Primary air is delivered from an air source via lines 13 through the air passages and is discharged onto opposite sides of the molten filaments as converging sheets of hot air. The converging sheets of hot air are directed to draw or attenuate the filaments in the direction of filament discharge from the orifices 28. The orientation of the orifices (i.e. their axes) determine the direction of filament discharge. The included angle between converging surfaces of the nosepiece 25 ranges from about 45° to 90°. It is important to observe that the above description of the meltblowing line is by way of illustration only. Other meltblowing lines may be used in combination with the crossflow air facilities described below.

The air conduits 17 may be tubular in construction having both ends closed defining an internal chamber 33. Each conduit 17 has at least one slot 34 formed therein. The slot 34 extends parallel to the axis of the conduit 17 and traverses the full row of orifices 28 in the die 11. The slot 34 of each conduit 17 is sized to provide air discharge velocities sufficiently high to contact the filaments. Velocities of at least 20 fps and between 300 and 1200 fps are preferred. Slots having a width of between 0.010 to 0.040 inches should be satisfactory for most applications. Flow rates through each slot of 20 to 300 SCFM per inch of orifice length (e.g. length of die tip 25) are preferred. The air delivery lines 18 may be connected at the ends of the conduits 17 as illustrated in FIG. 1 or may connect to a midsection to provide more uniform flow through the conduits 17. The air is delivered to the conduits at any pressure but low pressure air (less than 50 psi) is preferred. The conduits may be of other shapes and construction and may have more than one slot. For example, a conduit of square, rectangular, or semicircular cross section may be provided with one, two, or three or more parallel slots. The cross sectional flow area of each conduit may vary within a wide range, with 0.5 to 6 square inches being preferred and 0.75 to 3.5 square inches most preferred.

The conduits 17 may be mounted on a frame (not shown) to permit the following adjustments:
vertical ("a" direction in FIG. 2)
horizontal ("b" direction in FIG. 2)
angular (angle "A" in FIG. 2)

The angle A is the orientation of the longitudinal axis of the slot with reference to the vertical. A positive angle A (+A°) indicates the slot 34 is positioned to discharge air in a direction away from the die and thereby provide an air velocity component transverse or crosswise of the filament flow and a velocity component in the same direction as the primary air flow. A negative angle A (−A°), on the other hand, indicates the slot 34 is positioned to discharge air toward the die to provide an air velocity component transverse or crosswise the filament flow and a velocity component opposite the flow of the primary air. A zero angle A, of course, indicates the slot is positioned to discharge air at right angles to the direction of filament discharge (e.g. to the direction of orientation of the orifices 28). The reference to horizontal and vertical are merely for purposes of description. The relative dimensions a, b, and A will apply in any orientation of the extrusion die 11.

As mentioned previously, the main function of the crossflow air discharging from the slots 34 is to disrupt and alter the natural flow pattern or shape of the filaments discharging from the die 11. It is preferred that the cross flow air contact the filaments as close to the die 11 as possible (i.e. within ¼ the distance between the die 11 and the collector 15) and still provide for a generally uniform filament flow to the collector 15. Optimally, the crossflow air should disrupt the filaments within 1", preferably within ½", and most preferably within ¼" from the orifices. The conduits 17 are mounted, preferably, one above and one below the filament/air, having the following positions.

| | Broad Range | Preferred Range | Best Mode |
|---|---|---|---|
| a | ⅛ to 2½" | ⅛ to 1½" | ⅛ to ¼" |
| b | 0 to 8" | 0 to 5" | 0 to ½" |
| A | −40° to 70° | −35 to 45 | −20 to 10 |

The two conduits 17 may be positioned symmetrically on each side of the filament/air stream or may be independently operated or adjusted. Thus, the apparatus may include one or two conduits.

FIG. 2 illustrates the flow pattern of a filament 36*a* without the use of the crossflow conduits 17. As illustrated the filament 36 flows in a relatively straight line for a short distance (in the order of 1 inch) after discharge from the orifices 28 due to the drag forces exerted by the primary air flow. At about 1 inch from the die, the filament 36*a* flow shape begins to undulate reaching a region of violent flapping motion after about 3 to 6 inches. This flapping motion is believed to result in increased drawdown of the filament 36*a*.

The onset and behavior of the flapping motion is dependent on several factors including die slot width, nosepiece design, set back, operating temperatures, primary air flow rate, and polymer flow rate. Because so many variables are involved, it is not believed possible to control these variables with a high degree of certainty to achieve a desired amount of filament flapping. It appears to be an inherent behavior for a particular set of parameters. It is known, however, that in the initial region, the primary air flow is generally parallel to the filament flow so little or no flapping occurs in this region.

In accordance with the present invention, crossflow air is impinged on the filaments to initiate the onset of filament crosswise or flapping flow shape much closer to the die outlet. This earlier onset of flapping filament flow increases drawdown because the filament assumes an attitude crosswise of the primary air flow permitting a more efficient transfer of forces by the primary air flow. Moreover, the filaments are hotter and may even be in the molten or semimolten state during the early stages of the flapping flow behavior.

Using air conduits 17 to deliver cross flow air where a was ½", b was 1", and angle A was 0°, the filament 36 had the flow behavior, also depicted in FIG. 2. The crossflow air disrupted the filament flow almost immediately upon leaving the die 11 and is characterized by a larger region of high amplitude wave motion and much longer flapping region. Tests have shown that the induced flapping motion of the filament in accordance with the present invention decreases filament diameter significantly over conventional meltblowing (without crossflow air) under the same operating conditions. It is preferred that the crossflow air produced diameter decreases in the order of 10% to 70%, most preferably in the order of 15% to 60%. The resultant increase in polymer orientation increases the filament strength and the web strength. Tests indicate that the filaments have a more uniform size (diameter) distribution and the collected webs are stronger and tougher.

Operation

In carrying out the method of the present invention, the conduits 17 are placed over and/or under the die outlet and adjusted to the desired "a", "b", and angle "A" settings. The meltblowing line is operated to achieve steady state operations. The crossflow air then is delivered to the conduits 17 by a conventional compressor at the desired pressure. Some minor adjustments may be necessary to achieve optimum results.

It is important to note that the air conduits may be added to on any meltblowing die. For example, the die 11 may be as disclosed in U.S. Pat. No. 4,818,463 or U.S. Pat. No. 3,978,185, the disclosures of which are incorporated herein by reference.

Thermoplastic materials suitable for the process of the invention include polyolefins such as ethylene and propylene homopolymers, copolymers, terpolymers, etc. Suitable materials include polyesters such as poly(-methylmethacrylate) and poly (ethylene terephthate). Also suitable are polyamides such as poly (hexamethylene adipamide), poly(omega-caproamide), and poly (hexamethylene sebacamide). Also suitable are polyvinyls such as polystrene and ethylene acrylates including ethylene acrylic copolymers. The polyolefins are preferred. These include homopolymers and copolymers of the families of polypropylenes, polyethylenes, and other, higher polyolefins. The polyethylenes include LDPE, HDPE, LLDPE, and very low density polyethylene. Blends of the above thermoplastics may also be used. Any thermoplastic polymer capable of being spun into fine fibers by meltblowing may be used.

A broad range of process conditions may be used according to the process of the invention depending upon thermoplastic material chosen and the type of web/product properties needed. Any operating temperature of the thermoplastic material is acceptable so long as the materials is extruded from the die so as to form a nonwoven product. An acceptable range of temperature for the thermoplastic material in the die, and consequently the approximate temperature of the diehead around the material is 350° F.-900° F. A preferred range is 400° F.-750° F. For polpropylene, a highly preferred range is 400° F.-650° F.

Any operating temperature of the air is acceptable so long as it permits production of useable non-woven product. An acceptable range is 350° F.-900° F.

The flow rates of thermoplastic and primary air may vary greatly depending on the thermoplastic material extruded, the distance of the die from the collector (typically 6 to 18 inches), and the temperatures employed. An acceptable range of the ratio of pounds of primary air to pounds of polymer is about 20-500, more commonly 30-100 for polypropylene. Typical polymer flow rates vary from about 0.3-5.0 grams/hole/minute, preferably about 0.3-1.5.

EXPERIMENTS

Experiments were carried out using a one-inch extruder with a standard polypropylene screw and a die having the following description:

| | |
|---|---|
| no. of orifices | 1 |
| orifice size (d) | 0.015 inches |
| nosepiece included angle | 60° |
| orifice land length | 0.12 inches |
| Air slots (defined by air plates) | 2 mm opening and 2 mm neg. set back |

Other test equipment used in Series I Experiments included an air conduit semicircular in shape and having one longitudinal slot formed in the flat side thereof. The air conduits in the other Experiment were in the form of slotted pipes 1 inch in diameter.

SERIES I EXPERIMENTS

The resin and operating conditions were as follows:

| | |
|---|---|
| Resin: | 800 MFR PP (EXXON Grade 3495G) |
| Die Temp.: | 430° F. |
| Melt Temp.: | 430° F. |
| Primary Air Temp.: | 460° F. |
| Primary Air Rate: | 16.5 SCFM per in. of die width |
| Polymer Rate: | 0.8 gms/min. |
| Slot opening: | 0.030 in. |
| Web collector: | screen 12 inches from the die |

The a, b, and angle A values for the tests of this series were 1", 1½", and +30°, respectively. The data are shown in Table 1.

TABLE 1

| TEST NO. | CONDITION | CROSSFLOW AIR[3] CHAMBER PRESS. | BASIS WEIGHT GM/M2 | TYPE OF Web | AVG. Z-TENACITY[1] mN/TEX | DIAMETER[2] MICRONS | DIA. STD. DEVIATION |
|---|---|---|---|---|---|---|---|
| 1-1 | Base Case | 0 | 44.30 | Brittle | 10.5 | 7.93 | 2.93 |
| 1-2 | " | 0 | 41.77 | " | | | |
| 2-1 | Crossflow Device In Place | 0 | 39.90 | " | 15.6 | 7.57 | 2.80 |
| 2-2 | Crossflow Device In Place | 0 | 37.30 | " | 13.5 | | |
| 3-1 | Crossflow Device In Place + Secondary Air Taped Off | 0 | 40.80 | " | 13.4 | 8.33 | 3.67 |
| 3-2 | Crossflow Device In Place + Secondary Air | 0 | 40.80 | " | 12.4 | | |

TABLE 1-continued

| TEST NO. | CONDITION | CROSSFLOW AIR[3] CHAMBER PRESS. | BASIS WEIGHT GM/M2 | TYPE OF Web | AVG. Z-TENACITY[1] mN/TEX | DIAMETER[2] MICRONS | DIA. STD. DEVIATION |
|---|---|---|---|---|---|---|---|
| 4-1 | Taped Off Crossflow Device In Place | 5 | 37.30 | Tough, Soft | 19.4 | 6.59 | 2.20 |
| 4-2 | Crossflow Device In Place | 5 | 37.30 | " | 17.7 | | |
| 5-1 | Crossflow Device In Place | 14 | 33.80 | " | 22.3 | 6.52 | 1.87 |
| 5-2 | Crossflow Device In Place | 14 | 33.80 | " | 16.8 | | |
| 6-1 | Crossflow Device In Place + Secondary Air Taped Off | 14 | 31.60 | " | 19.3 | 6.87 | 2.18 |
| 6-2 | Crossflow Device In Place + Secondary Air Taped Off | 14 | 37.30 | " | 17.8 | | |
| 7-1 | Crossflow Device In Place + Secondary Air Taped Off | 5 | 32.90 | " | 19.6 | 7.65 | 2.26 |
| 7-2 | Crossflow Device In Place + Secondary Air Taped Off | 5 | 32.30 | " | 17.7 | | |

[1]Z-TENACITY was measured by cutting 1" wide strips and testing in an Instron tensile tester with zero separation between jaws. Jaw separation speed was 1.0 in/min.
[2]Average fiber diameter was measured by optical microscope with an overall magnification of 400. The microscope was focused on a sample of the web and every fiber within the view area was measured using a reticulated ocular. Several different focus areas were selected at random to give a total fiber count of 50. The average reported is a simple number average of all fiber measurements for each sample.
[3]The air velocities for 5 and 14 psi were 705 fps and 1030 fps, respectively.

The Table I data demonstrate that the crossflow air resulted in the following (a) The diameter of the filaments was decreased.
(b) The filament diameter distribution was more uniform.
(c) The web strength was improved.
(d) The quality of the web was improved.

SERIES II EXPERIMENTS

These tests employed the same line and polymer but with one tubular air conduit permitting adjustment of the a, b, and angle A settings. Table 2 presents the data for Series II Experiments.

TABLE 2

| TEST NO. | SETTINGS a | SETTINGS b | CROSSFLOW[1] CHAMBER PRESSURE psi | ANGLE A | AVG. FIBER DIAM. | STD. DEVIATION |
|---|---|---|---|---|---|---|
| 1 | — | — | — | — | 10.85 | 3.79 |
| 2 | ½" | ½" | 2 | −35° | 8.48 | 2.93 |
| 3 | " | " | 4 | " | 7.06 | 2.65 |
| 4 | " | " | 8 | " | 8.72 | 3.49 |
| 5 | ⅜" | ⅜" | 2 | −20° | 6.36 | 2.61 |
| 6 | " | " | 4 | " | 6.17 | 2.16 |
| 7 | " | " | 8 | " | 8.16 | 2.9 |
| 8 | ¼" | ⅞" | 2 | 0° | 8.6 | 2.4 |
| 9 | " | " | 4 | " | 7.65 | 2.65 |
| 10 | " | " | 8 | " | 9.58 | 2.05 |
| 11 | ⅜" | 1" | 2 | 20° | 9.0 | 3.22 |
| 12 | " | " | 4 | " | 8.96 | 2.65 |
| 13 | " | " | 8 | " | 9.22 | 3.23 |
| 14 | ½" | 5/4" | 2 | 45° | 9.22 | 2.48 |
| 15 | " | " | 4 | " | 8.66 | 3.0 |
| 16 | " | " | 8 | " | 8.47 | 1.98 |

[1]Air velocities at 2, 4, 6, and 8 psi were 476 fps, 654 fps, 761 fps, and 859 fps, respectively.

These data indicates that for all a, b, and A settings the filament avg. diameters were reduced and the size distributions were decreased. The 0 to negative angle settings (0 to −35°) gave the best results and are therefore preferred. Table 2 data indicates that the optimum crossflow chamber pressure or velocity depend on the geometry.

SERIES III EXPERIMENTS

These tests employed only one crossflow conduit (under the filament discharge) having a, b, and A settings of ⅜", ⅝", and −20, respectively. The primary air flow rate (at a temp. of 530°) was varied and the die and melt temperatures were 500°. The other conditions were the same as in Series I and II tests. The data for Series III tests are shown in Table 3.

TABLE 3

| TEST NO. | PRIMARY AIR RATE (SCFM*) | CROSSFLOW CHAMBER PRESSURE psi | AVERAGE FILAMENT DIAMETER | STD. DEVI-ATION |
|---|---|---|---|---|
| 1 | 11 | — | 8.77 | 3.33 |
| 2 | 18 | — | 5.07 | 2.56 |

TABLE 3-continued

| TEST NO. | PRIMARY AIR RATE (SCFM*) | CROSSFLOW CHAMBER PRESSURE psi | AVERAGE FILAMENT DIAMETER | STD. DEVIATION |
|---|---|---|---|---|
| 3 | 27 | — | 3.77 | 2.22 |
| 4 | 18 | 2 | 2.83 | 1.11 |
| 5 | 18 | 4 | 3.16 | 1.06 |
| 6 | 18 | 6 | 3.72 | 1.33 |
| 7 | 27 | 2 | 2.7 | 1.36 |
| 8 | 27 | 4 | 2.4 | 0.89 |
| 9 | 27 | 8 | 3.58 | 1.44 |

*per inch of die width

Test Runs 1-3 in this table show the effect on fiber diameter by increasing primary air rate with no crossflow air used. The use of crossflow air gives a significant reduction in diameter and diameter standard deviation at both low and high primary air rates. Again, an optimum crossflow air rate was observed. Highest crossflow air (8 spi) produced larger diameter filaments than medium crossflow air (4 psi), although still smaller than for the 0 crossflow air base case.

Best results appear to be obtained at crossflow velocities between 476 fps (2 psi) and 859 fps (8 psi). Tests have shown that chamber pressure as low as 1 psi can produce improved results.

SERIES IV EXPERIMENTS

These tests were conducted with two crossflow conduits illustrated in FIG. 2. Each conduit was adjusted independently of the other to provide different crossflow contact areas. The upper conduit had a, b, and A settings of ½", ¾", and +30°, respectively; and the lower conduit had a, b, and A settings of ½", 1", and −20, respectively. The data for Series III Experiments are presented in Table 4.

TABLE 4

| TEST NO. | CROSSFLOW CHAMBER PRESSURE PSI upper | lower | AVG. FIBER DIAMETER | STD. DEVIATION |
|---|---|---|---|---|
| 1 | 0 | 0 | 5.69 | 2.58 |
| 2 | 0 | 2 | 3.45 | 1.19 |
| 3 | 2 | 2 | 3.9 | 1.53 |
| 4 | 6 | 2 | 3.23 | 1.0 |
| 5 | 4 | 4 | 3.95 | 1.58 |
| 6 | 8 | 4 | 3.64 | 1.37 |

These data indicate that the settings of the upper and lower conduits can be varied and still provide improved results. It is significant to note that Test No. 2 using only the lower conduit gave better results than all but one of the other Series IV Experiments.

In summary, the method of the present invention may be viewed as a two stage air treatment of extruded filaments: the primary air contacts the filaments at an angle of between about 22° to about 45° to impart drag forces on the filaments in the direction of filament extrusion, the crossflow air contacts the extruded filaments at a point down stream of the contact point of the primary air and at a contact angle of at least 10° greater than the contact angle of the primary air on the same side of plane 12 to impart undulating flow shape to the extruded filaments. As viewed in FIG. 2 the contact angle of the primary air is determined by the center line of the passages 31 and 32 with plane 12. The contact angle of the crossflow air from conduit 17 above plane 12 (defined by the focus of slot 34 and plane 12) is at least 10° larger than the contact angle of the primary air from passage 31 as measured clockwise. Likewise, the contact angle of crossflow air from the conduit 17 below the plane 12 is at least 10° larger than the contact angle of the primary air from passage 32 as measured counterclockwise in FIG. 2. The crossflow air has a major velocity component perpendicular to the direction of filament extrusion and a minor velocity component parallel to the direction of filament extrusion.

What is claimed is:

1. In a a meltblowing method comprising extruding a polymer melt through a plurality of parallel orifices arranged in a row to form a plurality of filaments, contacting the extruded filaments with sheets of air converging from opposite sides of the row of filaments to impart drag forces on the filaments forming a filament/air stream, and depositing the filaments on a collector or substrate, the improvement comprising contacting the filaments in the filament/air stream with crossflow air to disrupt the normal flow shape of the filaments the crossflow air being of sufficient velocity and rate to create or increase undulations in the flow shape of the filaments thereby increasing the drawdown of the filaments and decreasing the average diameter of the filaments by at least 10% over that attainable without the crossflow air under the same operating conditions.

2. The method of claim 1 wherein the step of contacting the filaments with the crossflow air is carried out by directing air flow onto the extruded filaments in a region between the orifice discharge and ¼ the distance between the orifice discharge and the collector or substrate, the crossflow air flow being perpendicular to, or having a major velocity component perpendicular to, the axes of the orifices and a minor velocity component toward or away from the direction of filament discharge.

3. The method of claim 1 wherein the orifices of the meltblowing die have centerlines which lie in the same plane, and the crossflow air is in the form of a sheet, the direction of which forms an angle with said plane, said angle ranging from +45° to −35° with respect to the vertical where (+) indicates an angle away from the orifices and (−) indicates an angle toward the orifices.

4. The method of claim 1 wherein the crossflow air disrupts the normal flow patterns of the filaments within 1 inch from the discharge of the orifices.

5. The method of claim 1 wherein the crossflow air has a flow rate of between 20 to 300 SCFM per inch of the row of orifices and a velocity of between 200 to 1200 fps.

6. The method of claim 1 wherein the direction of the crossflow air has a major velocity component perpendicular to the direction of filament extrusion and a minor velocity component parallel to the direction of filament discharge.

7. The method of claim 1 wherein the orifices have a diameter between 100 to 1200 microns and the filaments deposited on the collector or substrate have a diameter of between 0.5 to 20 microns.

8. The method of claim 1 wherein the crossflow air disrupts the flow of the filaments within a region beginning within ½ inch of the orifice discharge.

9. The method of claim 1 wherein the step of contacting the filaments with crossflow air is carried out by directing crossflow air from a source positioned on one side of the filaments/air stream.

10. In a a meltblowing method comprising extruding a polymer melt through a plurality of parallel orifices arranged in a row to form a plurality of filaments, contacting the extruded filaments with sheets of air converging from opposite sides of the row of filaments to impart drag forces on the filaments forming a filament-/air stream, and depositing the filaments on a collector or substrate, the improvement comprising contacting the filaments in the filament/air stream with crossflow air to disrupt the normal flow shape of the filaments, the crossflow air being continuous and at the same rate and being of sufficient velocity and rate to create or increase undulations in the flow shape of the filaments thereby increasing the drawdown of the filaments.

11. In a a meltblowing method comprising extruding a polymer melt through a plurality of parallel orifices arranged in a row to form a plurality of filaments, contacting the extruded filaments with sheets of air converging from opposite sides of the row of filaments to impart drag forces on the filaments forming a filament-/air stream, and depositing the filaments on a collector or substrate, the improvement comprising contacting the filaments in the filament/air stream with crossflow air to disrupt the normal flow shape of the filaments, the crossflow air being of sufficient velocity and rate to create or increase undulations in the flow shape of the filaments thereby increasing the drawdown of the filaments, the direction of said crossflow air being at least 10 degrees greater than the angle of converging air sheet on the same side of the row of orifices.

* * * * *